US006672888B1

(12) United States Patent
Ku

(10) Patent No.: US 6,672,888 B1
(45) Date of Patent: Jan. 6, 2004

(54) CLAMP ASSEMBLY FOR AN ADVANCED GRAPHIC PORT (AGP) DISPLAY INTERFACE CARD

(75) Inventor: Yueh-Chu Ku, Taipei (TW)

(73) Assignee: Egbon Electronics Ltd., Taipei (TW)

( * ) Notice: Subject to any disclaimer, the term of this patent is extended or adjusted under 35 U.S.C. 154(b) by 0 days.

(21) Appl. No.: 10/326,465

(22) Filed: Dec. 20, 2002

(51) Int. Cl.[7] ..... H01R 13/62
(52) U.S. Cl. ..... 439/153; 439/157; 439/327
(58) Field of Search ..... 439/153, 155, 439/160, 157, 325, 327

(56) References Cited

U.S. PATENT DOCUMENTS 6,158,594 A * 12/2000 Boe ..... 211/41.17
6,368,124 B1 * 4/2002 Wang ..... 439/153
6,379,168 B1 * 4/2002 Wang ..... 439/160
6,551,120 B2 * 4/2003 Daskalakis et al. ..... 439/328

* cited by examiner

*Primary Examiner*—Truc Nguyen
(74) *Attorney, Agent, or Firm*—Dellett & Walters

(57) ABSTRACT

A clamp assembly for an AGP display interface card includes a connector and a seat extending from one end of a socket in which an AGP display interface card is mounted. The connector is securely connected to the seat and includes a latch and a resilient look to clamp a hook on the AGP display interface card. The latch holds the hook in the connector, and the resilient loop presses against the hook to keep the hook pressed against the latch when the AGP display interface card is mounted in the socket. Therefore the AGP display interface card is stably mounted in the socket and is easily removed from the socket by releasing the connector.

3 Claims, 8 Drawing Sheets

CLAMP ASSEMBLY FOR AN ADVANCED GRAPHIC PORT (AGP) DISPLAY INTERFACE CARD

BACKGROUND OF THE INVENTION

1. Field of the Invention

The present invention relates to a clamp assembly for an advanced graphic port (AGP) display interface card, more specifically to a clamp assembly that makes assembling the AGP display interface card and a socket mounted on the circuit board easy.

2. Description of Related Art

In general, any kind of interface card is connected to a corresponding socket by an edge connector on the interface card and a slot in the socket mounted on a main circuit board. However, when the main circuit board is moved and the interface card in the socket is shaken, the edge connector can separate from the slot in the socket and cause the interface card and the socket to disconnect.

With reference to FIG. 8, an AGP or AGP PRO display interface card (50) uses a connecting device (70) to hold the interface card (50) in a socket (60). The socket (60) has a top, a bottom, two long sides and two ends. The AGP display interface card (50) has an edge connector (51) and an L-shaped hook (52). The edge connector (51) is pressed into the socket (60). The L-shaped hook (52) has a short side (not numbered) and a long side (not numbered). An extension (61) of each long side of the socket (60) extends out from one end (not numbered) of the socket (60). Each extension (61) has an outside surface, an inside surface and a pivot hole (611) defined on the inside surface of each extension (61).

The connecting device (70) has a body (not numbered) with two edges (not numbered), two pivots (72) formed respectively on opposite edges of the body and a handle (73). A through hole (71) is formed through the body. The pivots (72) and the handle (73) are integrally formed with the body. The two pivots (72) respectively correspond to the two pivot holes (611) so the connecting device (70) can be pivotally connected between the extensions of the socket (60). The handle (73) of the connecting device (70) is controlled to rotate the body on the socket (30). When the AGP display interface card (50) is inserted into the socket (60), the long side of the L-shaped hook (52) is inserted into the through hole (71) in the body of the connecting device (70). The connecting device (70) securely holds the AGP display interface card (50) in the socket (60). Therefore, the AGP display interface card (50) with the connecting device (70) is not easily separated from the socket (60). However the connecting device (70) still has some drawbacks including:

(1) a weak connection between the AGP display interface card and the socket having a pivotal connecting with the connecting device; and (2) a complex design with very small tolerances such as the distance or gaps between the hook, position of the through hole and the pivot holes in the socket.

Therefore, the present invention provides a clamp assembly for an AGP display interface card to mitigate or obviate the aforementioned problems.

SUMMARY OF THE INVENTION

An objective of the present invention is to provide a clamp assembly that has easy operation and securable connecting capability for connecting between an AGP display interface card and a socket on a main circuit board.

Another objective of the present invention is that the clamp assembly is simple and inexpensive.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
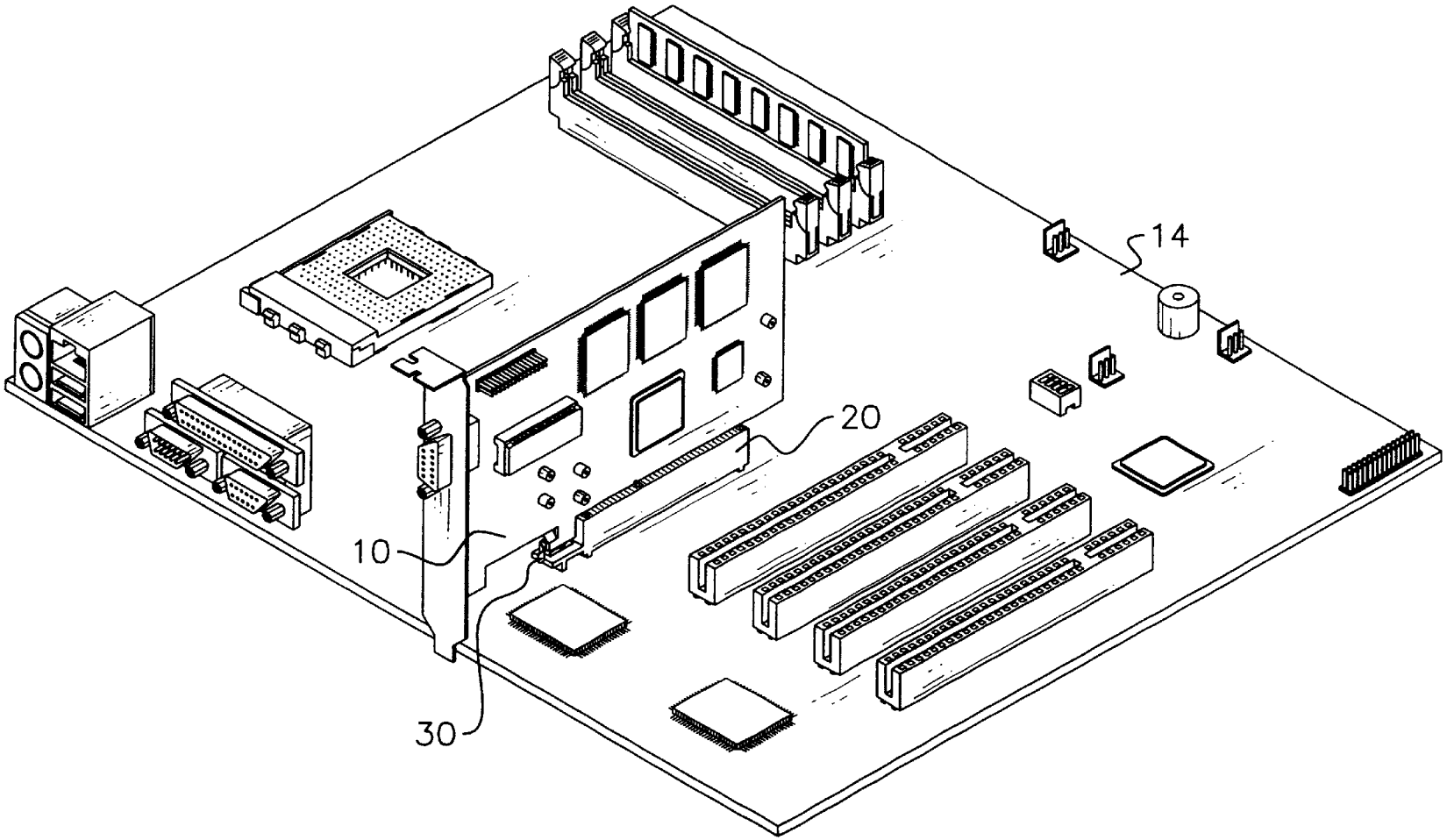
FIG. 1 is a perspective view of a main circuit board with a clamp assembly for an AGP display interface card in accordance with the present invention.
Figure 2:
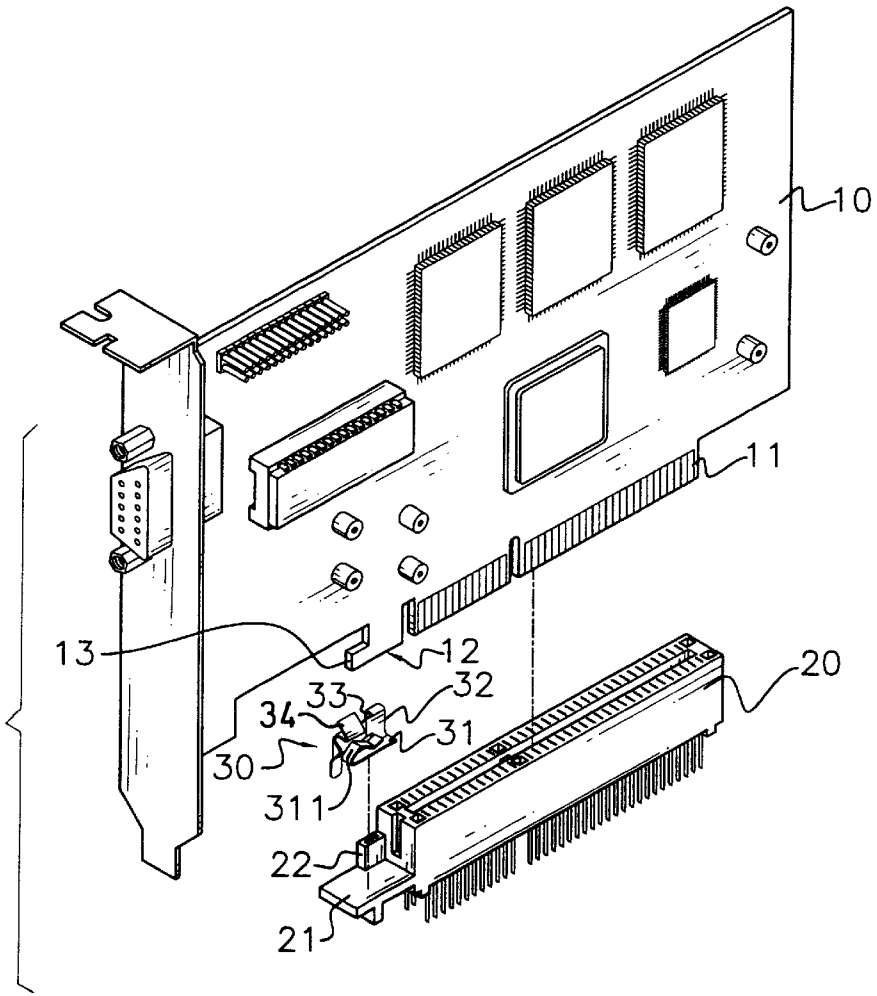
FIG. 2 is an exploded perspective view of the clamp assembly in FIG. 1.

With reference to FIGS. 1 and 2, a clamp assembly for an advanced graphic port (AGP) display interface card securely holds the interface card in a socket (20) mounted on a main circuit board (14). The socket (20) has a slot, a top, a bottom, two sides and two ends. The clamp assembly includes a connector (30) and a seat (21). The seat (21) is formed on and extends longitudinally out from one end of the socket (20).

The AGP display interface card has a body (10), an edge connector (11) and an L-shaped hook (12). The body (10) is a printed circuit board with a bottom edge, a front edge and a back edge. The hook (12) and the edge connector (11) are integrally formed with and extend from the bottom edge of the body (10) with a small gap between the hook (12) and the edge connector (11). The hook (12) has a short side (not numbered) and a long side (13). The seat (21) is integrally formed on one end of the socket (20), extends longitudinally away from the socket (20) and has a top surface (not numbered) and a mounting socket (22). The mounting socket (22) is vertically formed on the top surface of the seat (21) and abuts the end of the socket (20).

Figure 4:
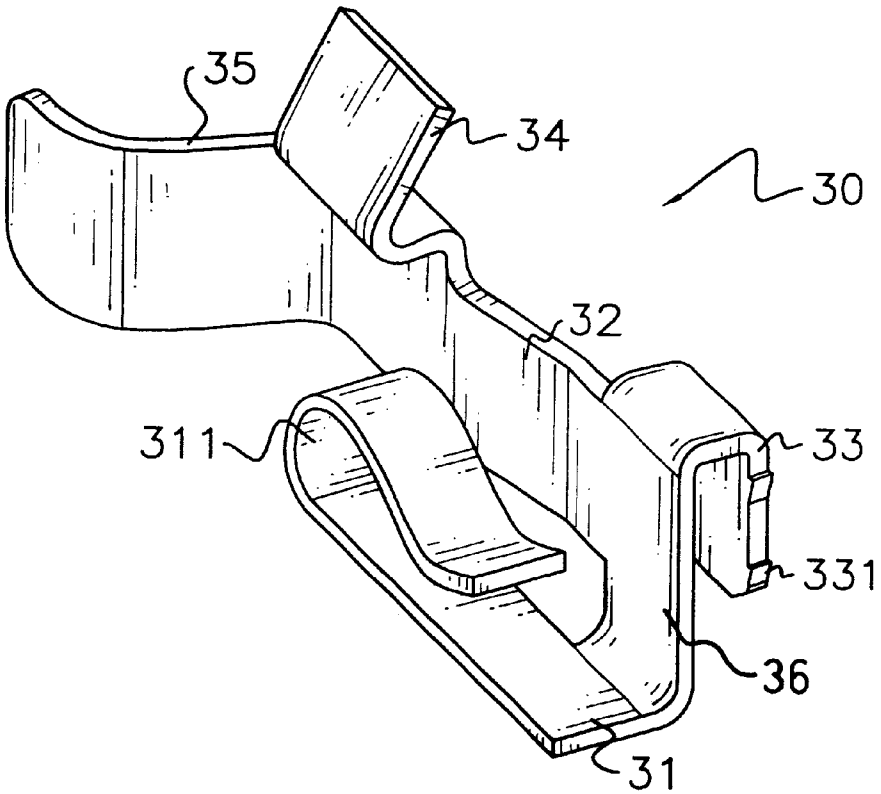
FIG. 4 is a perspective view of a connector of the clamp assembly in FIG. 2.

With reference to FIG. 4, the clamping clip (30) has a resilient long plate (32), a short plate (31), an inverted L-shaped fixed connector (33), a thumb tab (35) and a resilient latch (34). The long plate (32) has a top edge (not numbered), a bottom edge (not numbered), a first end (not numbered), a second end (not numbered), a short perpendicular extension (36), a first surface (not numbered) and a second surface (not numbered). The short perpendicular extension (36) is integrally formed with and extends down from the bottom edge at the second end of the long plate (32) and has a distal end (not numbered).

The short plate (31) is longitudinally perpendicular to first surface of the long plate (32) and has a first end (not numbered), a second end (not numbered), an inside edge (not numbered), an outside edge (not numbered), a top surface (not numbered) and a resilient loop (311). The inside edge of the short plate (31) is integrally formed with the distal end of the perpendicular extension (36) from the second end of the long plate (32). The resilient loop (311) is integrally formed on the first end of the short plate (31) and bends back toward the top surface of the short plate (31).

The inverted L-shaped fixed connector (33) has a first edge (not numbered), a second edge (not numbered), a distal end (not numbered) and multiple barbs (331), is integrally formed with the top edge of the long plate (32) and extends down parallel to the second surface at the first end of the long plate (32). Multiple barbs (331) are formed on the first and second edges (not numbered) of the inverted L-shaped connector (33).

The resilient latch (34) has a proximal end (not numbered), a distal end (not numbered) and a lip (not numbered). The proximal end of the latch (34) is integrally formed with the top edge of the long plate (32) at the first end of the long plate (32). The latch (34) is bent to form the lip, and the distal end of the latch extends up, away from the long plate (32).

The thumb tab (35) is an extension from the first end of the long plate (32). The thumb tab (35) is curved and has a distal end that extends away from the first end of the long plate (32). The thumb tab (35) is an arc-shape.

Figure 5:
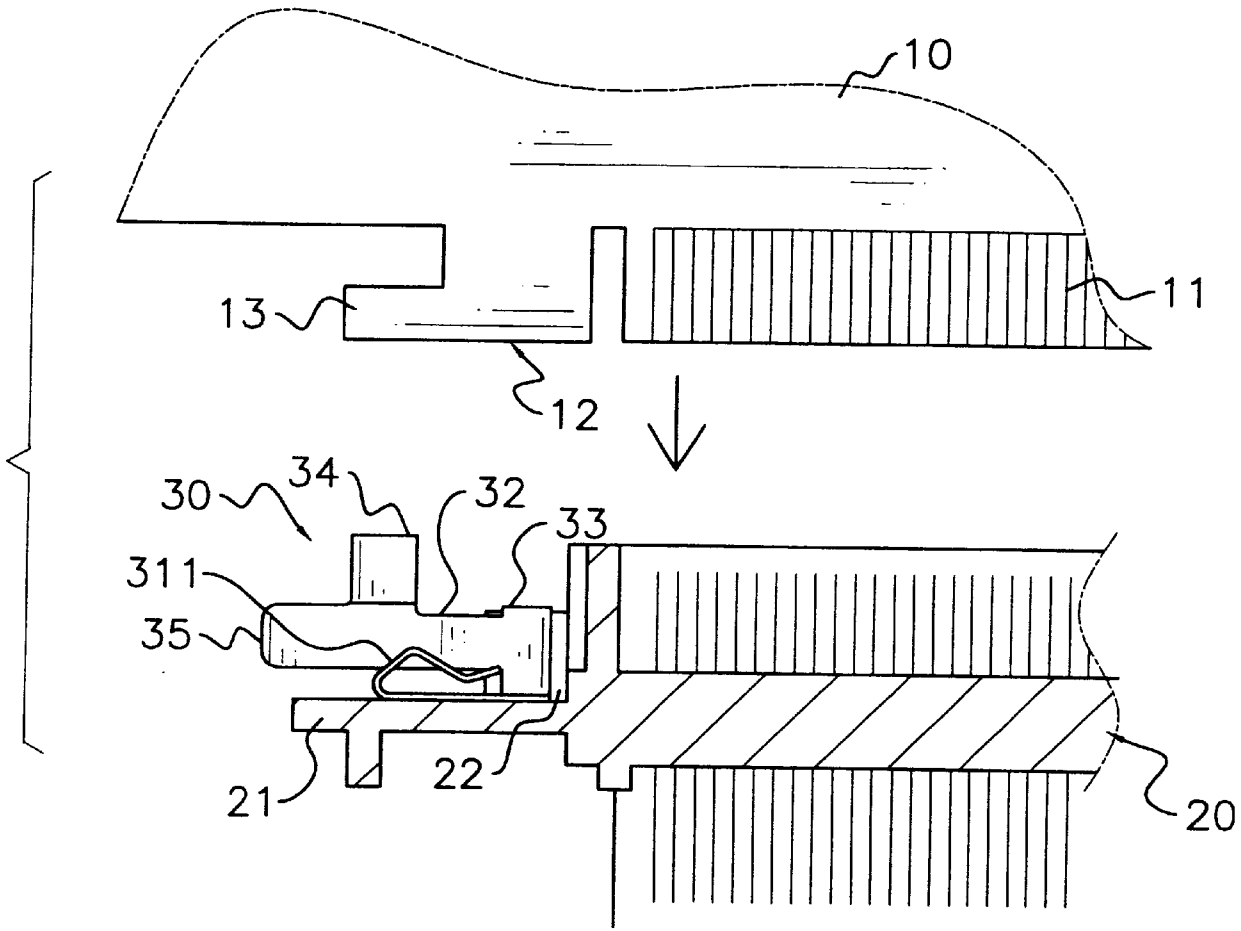
FIG. 5 is an enlarged operational side plan view of the clamp assembly in FIG. 3.

With reference to FIGS. 2 and 5, the clamping clip (30) is attached to the socket (20) by inserting the inverted L-shaped connector (33) into the mounting socket (22). The connector (30) extends away from the end of the socket (20), and the short plate (31) abuts the seat (21). The barbs (331) on the inverted L-shaped connector (33) securely hold the connector (30) in the mounting socket (22).

When the edge connector (11) of the AGP display interface card (10) is pressed down into the socket (20), the hook (12) aligns with the connector (30). The long side (13) of the hook (12) first touches the latch (34), and the latch (34) is pushed back to allow the long side (13) of the hook (12) to press down against to the resilient loop (311) below the latch (34). When the long side (13) of the hook (12) moves below the latch (34), the latch (34) is released to reinstate original position. The long side of the hook (12) is clamped between the latch (34) and the resilient loop (311).

Figure 3:
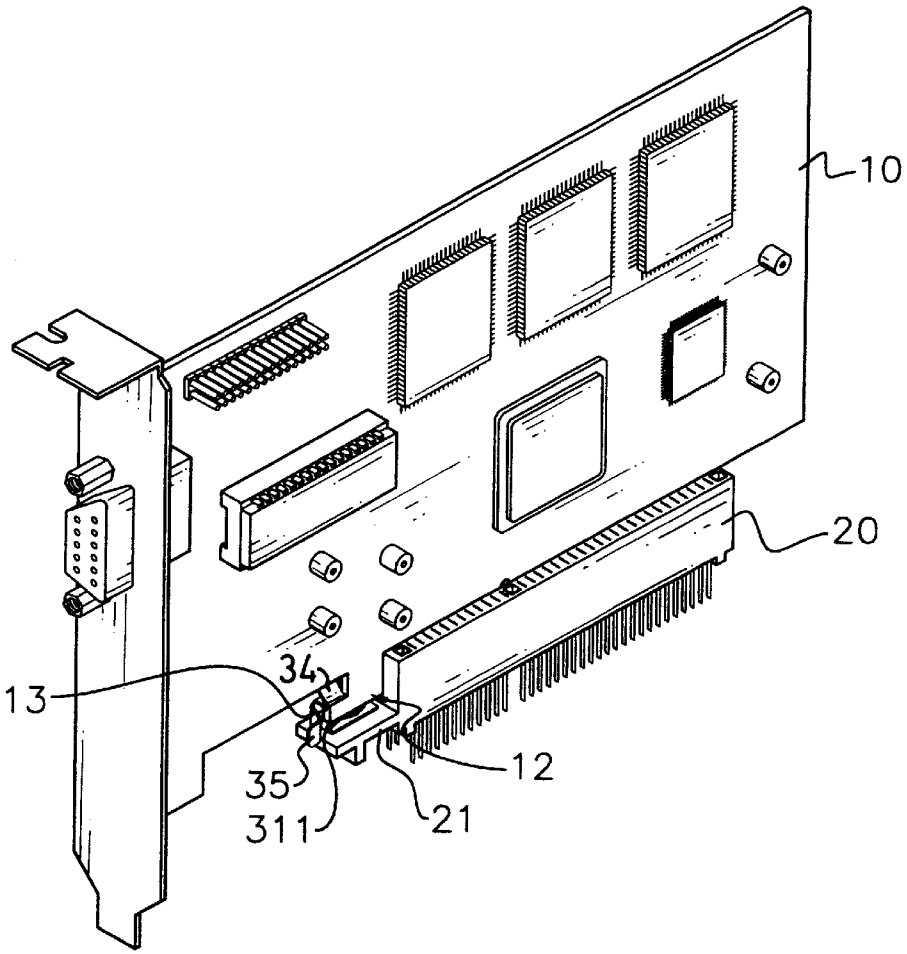
FIG. 3 is a perspective view of the clamp assembly in FIG. 2.
Figure 6:
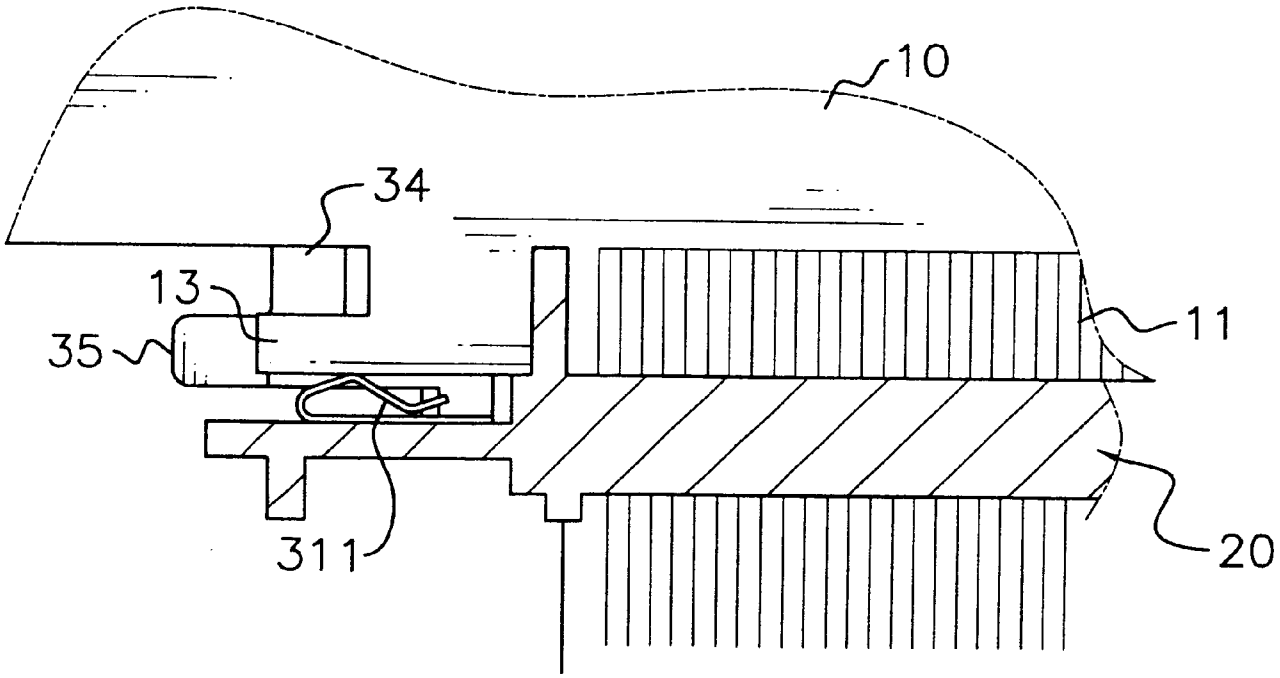
FIG. 6 is an enlarged side plan view in the FIG. 3.

With reference to FIGS. 3 and 6, when the long side (13) of the hook (12) is clamped between the latch (34) and the resilient loop (311), the edge connector (11) of the AGP display interface card (10) is completely seated in the socket (20). The AGP display interface card (10) is securely held in the socket (20) by the connector (30) mounted on the seat (21).

Figure 7:
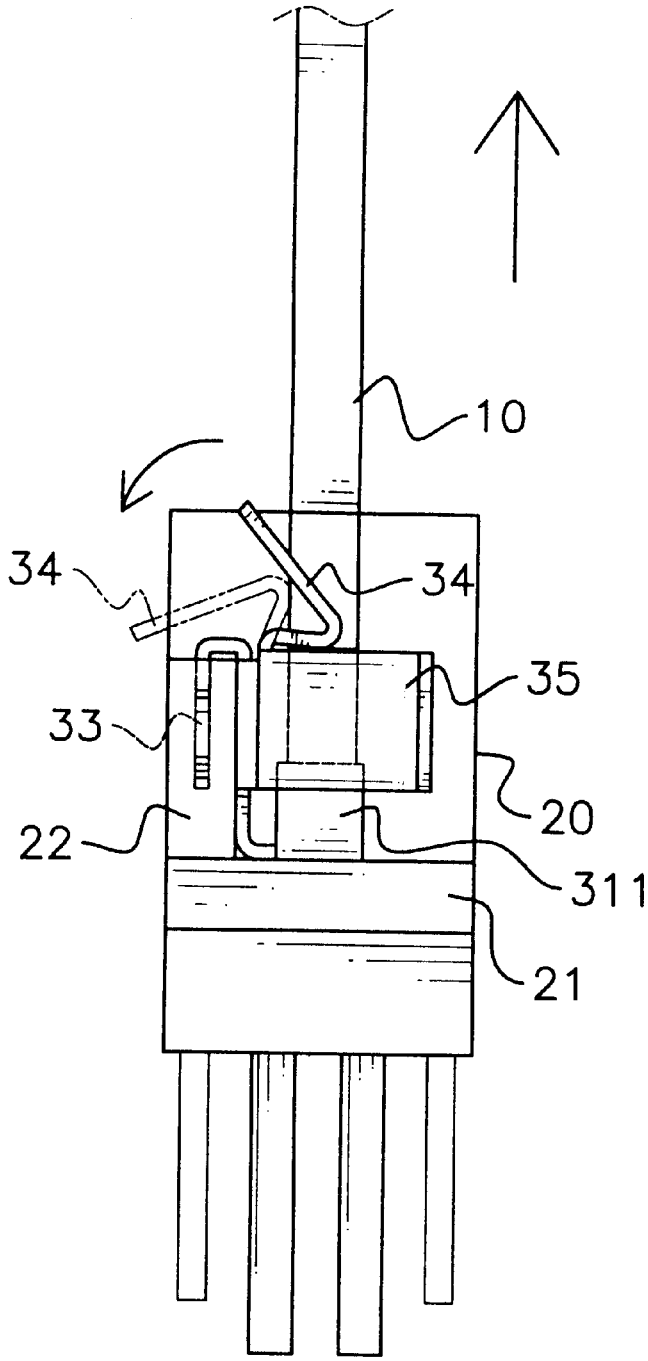
FIG. 7 is an enlarged operational front plan view of the clamp assembly in FIG. 3.
Figure 8:
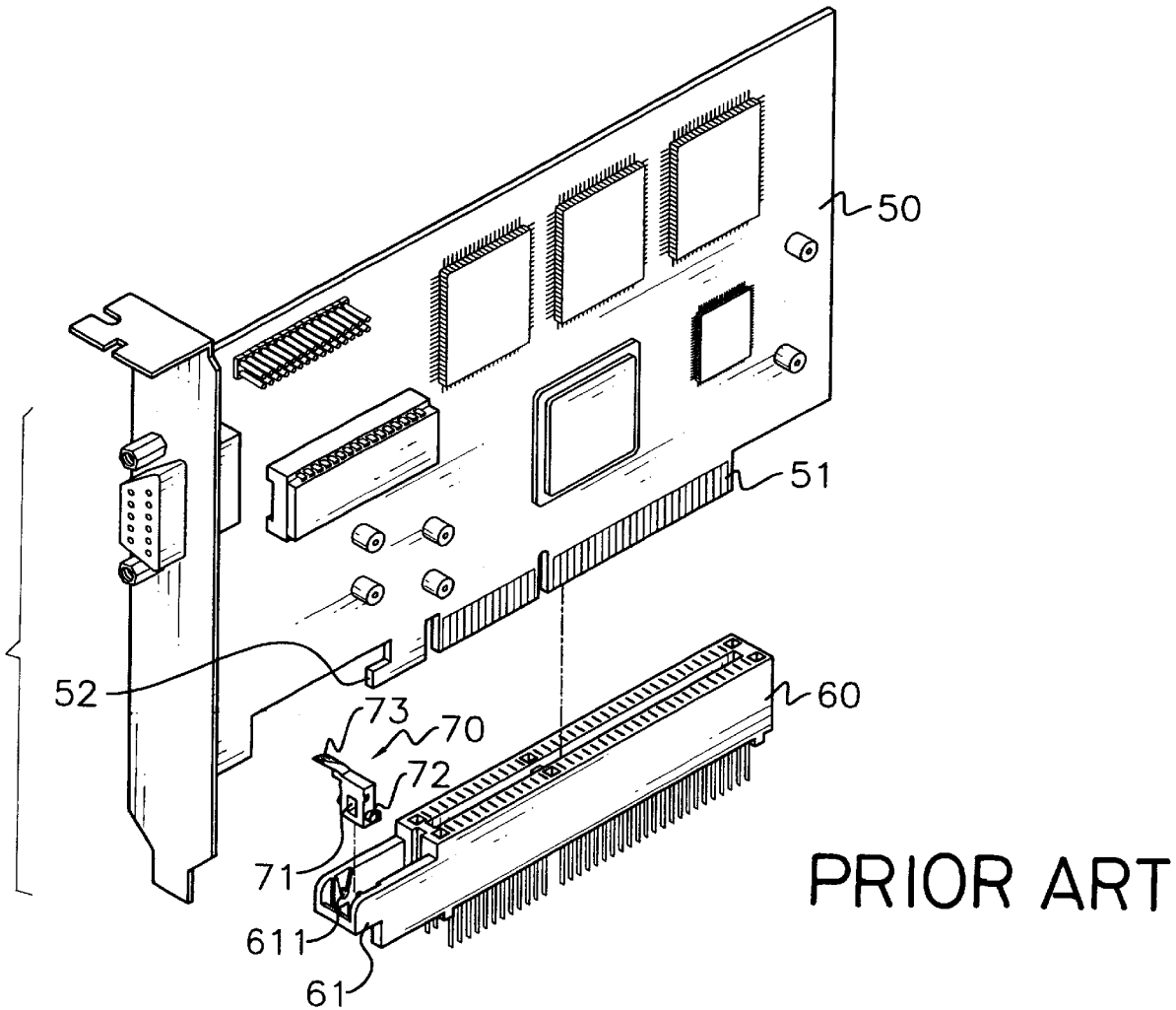
PRIOR ART FIG.8
FIG. 8 is an exploded perspective view of a conventional clamp assembly adapted for use with an AGP display interface card.

With reference to FIG. 7, when the AGP display interface card (10) is pulled up from the socket (20), the distal end of the latch (34) first is pull down to release the long side (13) of the hook (12). Alternately, the thumb tab (35) can be pulled back to help release the latch (34) from the hook (12). When the hook (13) is released from the latch (34), the resilient loop (311) provides an elastic force to push the long side (13) of the hook (12) up. Therefore, the AGP display interface card is easily removed from the socket (20).

The clamp assembly has the following advantages:

(1) strong connection between the connector and the socket by the L-shaped connector of the connector and the mounting socket on the seat of the socket;

(2) strong connection between the AGP display interface card and the socket by the connector;

(3) simple structure; and (4) easy use and operation by moving the latch and/or the thumb tab.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A clamp assembly for an AGP display interface card, wherein an AGP display interface card has a hook near an edge connector inserted into a socket, the clamp assembly comprising:

a seat adapted to extend outward from one end of the socket, on which a mounting socket is formed integrally; and a clamping clip supported on the seat and having a resilient long plate, a short plate, an inverted L-shaped fixed connector and a resilient latch, wherein the long plate has a top edge, a bottom edge, a first end, a second end and a short perpendicular extension, wherein the inverted L-shaped fixed connector is inserted into the mounting socket and has two opposite edges and is integrally formed with the top edge and extends down parallel to the long plate, wherein multiple barbs are formed on each opposite edges of the L-shaped connector; and the resilient latch is formed on the top edge of the long plate; and the short plate connected to the long plate has a resilient loop horizontally and integrally extended from the short plate, wherein the resilient loop corresponds to the resilient latch of the long plate;

whereby the clamping clip securely connects to the socket by the inverted L-shaped fixed connector with the barbs being inserted into the mounting socket on the seat and further stably clamps the hook of the AGP display interface card.

2. The clamp assembly as claimed in claim 1, wherein the long plate further comprises a thumb tab horizontally and integrally extending from the first end of the long plate.

3. The clamp assembly as claimed in claim 2, wherein the thumb tab is an arc-shape.

* * * * *